US011828462B2

(12) United States Patent
Cowan

(10) Patent No.: US 11,828,462 B2
(45) Date of Patent: Nov. 28, 2023

(54) GAS VALVE MOUNTING ASSEMBLY FOR GAS COOKING APPLIANCE

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 318 days.

(21) Appl. No.: 17/202,972

(22) Filed: Mar. 16, 2021

(65) Prior Publication Data

US 2022/0299204 A1 Sep. 22, 2022

(51) Int. Cl.
*F24C 3/12* (2006.01)
*F23N 1/00* (2006.01)

(52) U.S. Cl.
CPC ..... *F23N 1/005* (2013.01); *F24C 3/122* (2013.01)

(58) Field of Classification Search
CPC ..... F24C 3/122; F24C 3/124
See application file for complete search history.

(56) References Cited

U.S. PATENT DOCUMENTS

| | | | |
|---|---|---|---|
| 8,662,102 B2 | 3/2014 | Shaffer et al. | |
| 9,976,749 B2 | 5/2018 | Yang et al. | |
| 2010/0216080 A1 | 8/2010 | Home | |
| 2017/0089586 A1* | 3/2017 | Turner | F24C 3/126 |
| 2017/0191671 A1 | 7/2017 | Chambers et al. | |
| 2018/0017263 A1 | 1/2018 | Roberts et al. | |

FOREIGN PATENT DOCUMENTS

EP 2942567 B1 1/2018

OTHER PUBLICATIONS

The BBQ Depot, Charbroil, Kenmore Brass Clamp-on Valve-3730C, The BBQ Depot, Inc. BBQ Grills, Parts & Accessories, Retrieved from: https://www.thebbqdepot.com/brass-clamp-on-valve-charbroil/, Retrieved on Mar. 16, 2021.
Charbroil, Natural Gas Conversion Kit, Commercial Series Char-Broil, Char-Broil, LLC, Sep. 29, 2007.
Charbroil, Valve/Hose/Regulator, Model #G432-3000-W1, Retrieved from: https://www.charbroil.com/valve-hose-regulator-g432-3000-w1, Retrieved on Mar. 16, 2021.
Char-Broil, Product Guide Model 463411911, Char-Broil, LLC, Feb. 14, 2011.
Char-Broil, Model 463248708 Product Guide, Commercial Infrared Char-Broil, Mar. 27, 2008.

(Continued)

*Primary Examiner* — Reinaldo Sanchez-Medina
(74) *Attorney, Agent, or Firm* — Gray Ice Higdon

(57) ABSTRACT

A cooking appliance includes a gas valve mounting assembly for mounting a gas valve for a gas cooktop burner to a control panel of the appliance. The gas valve mounting assembly includes a valve attachment plate that secures to and generally circumscribes the gas valve and extends generally transversely to an actuation axis of the gas valve, as well as multiple standoffs having respective first and second ends and extending generally parallel to the actuation axis of the gas valve to secure the valve attachment plate to the control panel.

20 Claims, 5 Drawing Sheets

(56) References Cited

OTHER PUBLICATIONS

Char-Broil, Part CHR80016867 Valve/Manifold/Regulator Includes Valve, Appliance Factory Parts, Retrieved from: https://www.appliancefactoryparts.com/search/part/455786/132343, Retrieved on Mar. 16, 2021.

Char-Broil, Gas Grill Regulator and Valve Manifold Assembly 30225001, Sears, Retrieved from https://www.searspartsdirect.com/product/3tfwmbescx-0071-415/id-30225001, Retrieved on Mar. 16, 2021.

* cited by examiner

GAS VALVE MOUNTING ASSEMBLY FOR GAS COOKING APPLIANCE

BACKGROUND

Cooking appliances such as cooktops, ovens and ranges may be powered by various types of burners or cooking elements, with electrical heating elements and gas burners being among the most common. In particular, gas burners generally use as an energy source a combustible gas such as natural gas or liquified petroleum (LP) gas (also referred to as propane), and generate heat by combusting and burning the gas. The output levels of gas burners are generally controlled by valves, which regulate gas flow to the gas burners, and which in some instances are coupled mechanically to associated user controls, e.g., knobs that are rotatable by a user to control gas flow rates through the valves. Gas burners also generally require some manner of igniting the burners, and many gas cooktop burners utilize spark igniters that are also activated based upon the positions of the associated user controls for the gas burners.

It is generally desirable to assemble the gas valves in a cooking appliance such that their positions are fixed and such that good alignment is achieved between the valve stem, knob, control panel, and other parts of the appliance. This is generally both for appearance and for functionality. It is desirable therefore for a mounting assembly for a cooking appliance gas valve to be economical, secure and easy to fabricate and assemble.

SUMMARY

The herein-described embodiments address these and other problems associated with the art by utilizing a gas valve mounting assembly in a gas cooking appliance that incorporates a valve attachment plate that generally circumscribes a gas valve and extends generally transversely to an actuation axis of the gas valve, as well as multiple standoffs that extend generally parallel to the actuation axis of the gas valve. The attachment plate and standoffs attach to one another, and may be used to mount the gas valve to a control panel of the gas cooking appliance with the gas valve attached to the attachment plate and the standoffs attached to the control panel.

Therefore, consistent with one aspect of the invention, a cooking appliance may include a housing including a cooktop and a control panel, a gas burner disposed on the cooktop, a gas valve including a valve body and a rotatable shaft configured to regulate gas flow to the gas burner through rotation of the rotatable shaft about an actuation axis, a burner control coupled to the rotatable shaft of the gas valve, and a gas valve mounting assembly mounting the gas valve to the control panel of the housing. The gas valve mounting assembly may include a valve attachment plate that secures to and generally circumscribes the gas valve and extends generally transversely to the actuation axis of the gas valve, and a plurality of standoffs having respective first and second ends and extending generally parallel to the actuation axis of the gas valve, the respective first ends of the plurality of standoffs secured to the valve attachment plate and the respective second ends of the plurality of standoffs secured to the control panel of the housing to thereby mount the gas valve to the control panel of the housing.

In some embodiments, the control panel includes a control aperture through which the rotatable shaft of the gas valve projects when the gas valve is mounted to the control panel. In some embodiments, the control aperture has an area that is less than a cross-sectional area of the burner control such that the burner control fully covers the control aperture when the burner control is coupled to the rotatable shaft of the gas valve, and the control panel further includes a plurality of mounting apertures through which the plurality of standoffs are secured to the control panel using a plurality of fasteners. Further, in some embodiments, each of the plurality of standoffs includes an alignment pin and a fastener recess disposed at the respective second end thereof, the plurality of fasteners are received in the fastener recesses of the plurality of standoffs, and the control panel further includes a plurality of alignment apertures configured to receive the alignment pins of the plurality of standoffs to align the plurality of mounting apertures with the fastener recesses of the plurality of standoffs.

In some embodiments, the control aperture has an area that is greater than a cross-sectional area of the burner control and the control panel includes a control bezel that is received in the control aperture on an opposite side of the control panel from the gas valve, and the control bezel further includes a plurality of mounting apertures through which the plurality of standoffs are secured to the control panel using a plurality of fasteners. In addition, in some embodiments, each of the plurality of standoffs includes an alignment pin and a fastener recess disposed at the respective second end thereof, the plurality of fasteners are received in the fastener recesses of the plurality of standoffs, and the control bezel further includes a plurality of alignment apertures configured to receive the alignment pins of the plurality of standoffs to align the plurality of mounting apertures with the fastener recesses of the plurality of standoffs.

In some embodiments, the valve attachment plate includes a plurality of mounting apertures through which the plurality of standoffs are secured to the valve attachment plate using a plurality of fasteners. In addition, in some embodiments, each of the plurality of standoffs includes an alignment pin and a fastener recess disposed at the respective first end thereof, the plurality of fasteners are received in the fastener recesses of the plurality of standoffs, and the valve attachment plate further includes a plurality of alignment apertures configured to receive the alignment pins of the plurality of standoffs to align the plurality of mounting apertures with the fastener recesses of the plurality of standoffs.

Moreover, in some embodiments, the valve attachment plate fully circumscribes the gas valve and defines a valve aperture through which the gas valve projects. In some embodiments, the gas valve includes a plurality of fastener recesses extending generally parallel to the actuation axis of the gas valve, and the valve attachment plate includes a plurality of mounting apertures through which the valve attachment plate is secured to the gas valve using a plurality of fasteners received in the plurality of fastener recesses. Moreover, in some embodiments, the valve attachment plate further includes a switch recess configured to receive a portion of an electrical switch that is actuated by rotation of the burner control.

Consistent with another aspect of the invention, a gas valve assembly for a cooking appliance of a type including a control panel and a cooktop having a gas burner may include a gas valve including a valve body and a rotatable shaft configured to regulate gas flow to the gas burner through rotation of the rotatable shaft about an actuation axis, and a gas valve mounting assembly configured to mount the gas valve to the control panel. The gas valve mounting assembly may include a valve attachment plate that secures to and generally circumscribes the gas valve and extends generally transversely to the actuation axis of the gas valve, and a plurality of standoffs having respective first and second ends and extending generally parallel to the actuation axis of the gas valve, the respective first ends of the plurality of standoffs secured to the valve attachment plate and the respective second ends of the plurality of standoffs configured to be secured to the control panel to thereby mount the gas valve to the control panel.

In some embodiments, each of the plurality of standoffs includes an alignment pin and a fastener recess disposed at the respective second end thereof, the plurality of fastener recesses are configured to receive a plurality of fasteners that secure the gas valve mounting assembly to the control panel through a plurality of mounting apertures in the control panel, and the plurality of alignment pins are configured to be received in a plurality of alignment apertures disposed in the control panel. In addition, in some embodiments, the valve attachment plate includes a plurality of mounting apertures through which the plurality of standoffs are secured to the valve attachment plate using a plurality of fasteners.

In some embodiments, each of the plurality of standoffs includes an alignment pin and a fastener recess disposed at the respective first end thereof, the plurality of fasteners are received in the fastener recesses of the plurality of standoffs, and the valve attachment plate further includes a plurality of alignment apertures configured to receive the alignment pins of the plurality of standoffs to align the plurality of mounting apertures with the fastener recesses of the plurality of standoffs. Moreover, in some embodiments, the valve attachment plate fully circumscribes the gas valve and defines a valve aperture through which the gas valve projects.

Also, in some embodiments, the gas valve includes a plurality of fastener recesses extending generally parallel to the actuation axis of the gas valve, and the valve attachment plate includes a plurality of mounting apertures through which the valve attachment plate is secured to the gas valve using a plurality of fasteners received in the plurality of fastener recesses. In some embodiments, the valve attachment plate further includes a switch recess configured to receive a portion of an electrical switch that is actuated by rotation of the rotatable shaft of the gas valve.

Consistent with another aspect of the invention, a gas valve mounting assembly may be provided for mounting a gas valve to a control panel of a cooking appliance of a type including a cooktop having a gas burner, the gas valve including a valve body and a rotatable shaft configured to regulate gas flow to the gas burner through rotation of the rotatable shaft about an actuation axis. The gas valve mounting assembly may include a valve attachment plate configured to be secured to and generally circumscribe the gas valve and extend generally transversely to the actuation axis of the gas valve, and a plurality of standoffs having respective first and second ends and extending generally parallel to the actuation axis of the gas valve, the respective first ends of the plurality of standoffs secured to the valve attachment plate and the respective second ends of the plurality of standoffs configured to be secured to the control panel to thereby mount the gas valve to the control panel.

In addition, some embodiments may also include a plurality of first fasteners securing the plurality of standoffs to the valve attachment plate through a plurality of first mounting apertures in the valve attachment plate, each of the plurality of standoffs includes a first alignment pin and a first fastener recess disposed at the respective first end thereof and a second alignment pin and a second fastener recess disposed at the respective second end thereof, the plurality of first fasteners are received in the first fastener recesses of the plurality of standoffs, and the attachment plate further includes a plurality of alignment apertures configured to receive the first alignment pins of the plurality of standoffs to align the plurality of first mounting apertures with the fastener recesses of the plurality of standoffs, and the plurality of second fastener recesses are configured to receive a plurality of second fasteners that secure the gas valve mounting assembly to the control panel through a plurality of second mounting apertures in the control panel, and the plurality of second alignment pins are configured to be received in a plurality of second alignment apertures disposed in the control panel.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

In the embodiments discussed hereinafter, a gas cooking appliance may include a gas valve mounting assembly incorporating a valve attachment plate that generally circumscribes a gas valve and extends generally transversely to an actuation axis of the gas valve in combination with multiple standoffs that extend generally parallel to the actuation axis of the gas valve and serve to mount the gas valve to a control panel of the gas cooking appliance with the gas valve attached to the attachment plate and the standoffs attached to the control panel. As will become more apparent below, such a gas valve mounting assembly may be used to economically and securely mount a gas valve in a gas cooking appliance.

Figure 1:
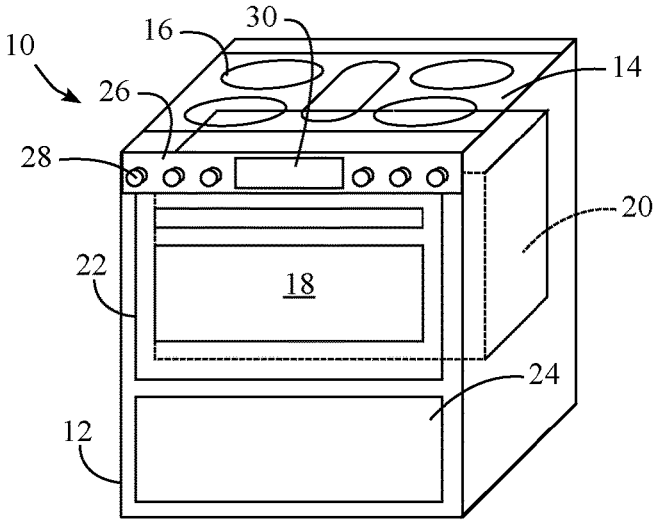
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas heating elements.

Cooking appliance 10 may also include various user interface devices, including, for example, a control panel 26 incorporating a plurality of rotary burner controls 28 and a user interface or display 30 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 30 may be touch sensitive to receive user input in addition to displaying status information and/or otherwise interacting with a user.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a cooktop, stovetop or hob lacking an integrated oven, a wall-mounted oven lacking an integrated cooktop, or an indoor or outdoor grill. In general, a cooking appliance consistent with the invention may be considered to include any residential-type appliance in which one or more gas valves configured to regulate the outputs of associated gas cooktop burners may be mounted to a control panel or other structure in the cooking appliance.

Figure 2:
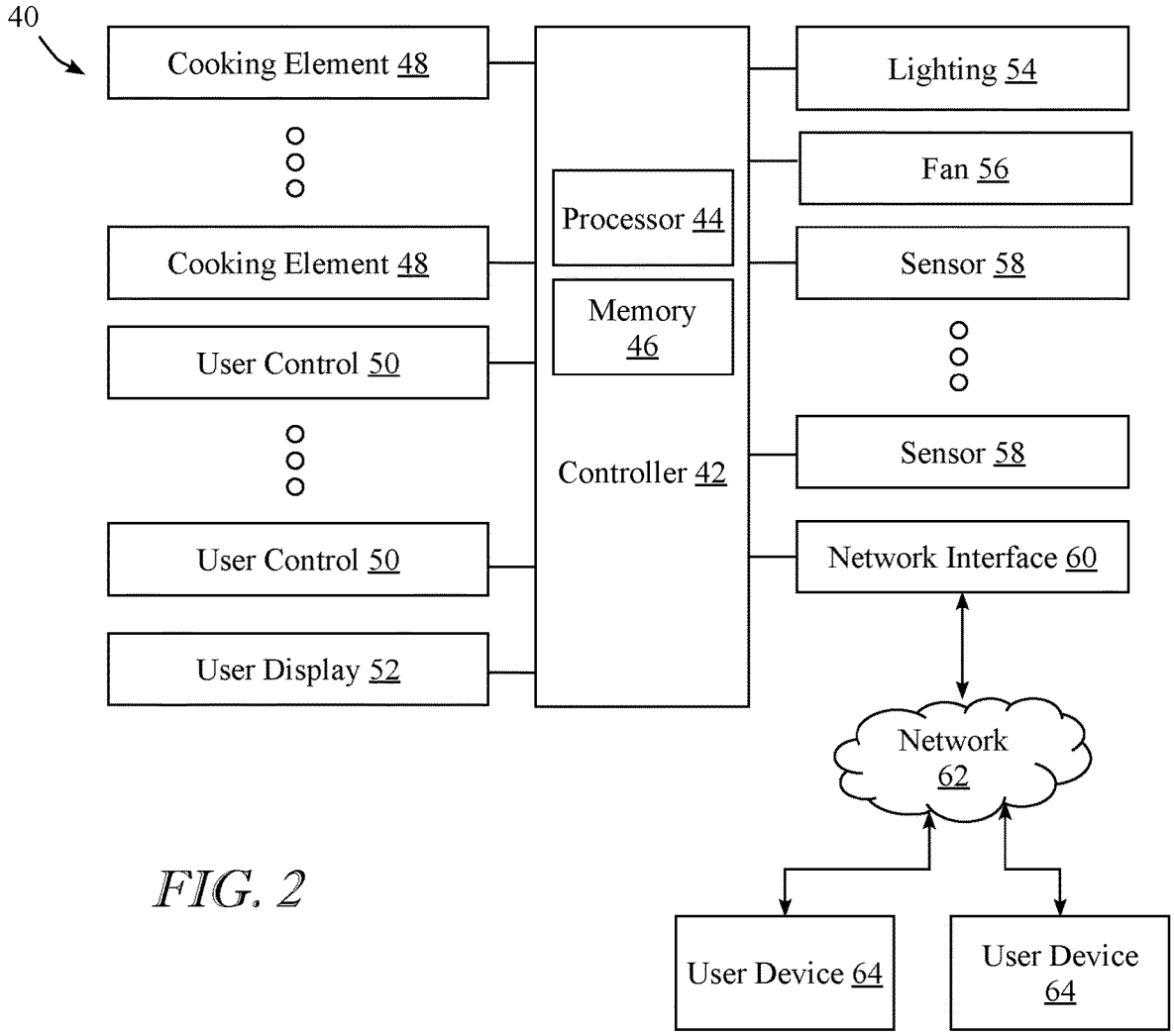
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others. It will be appreciated that for some types of cooking elements and/or controls therefor, e.g., gas cooking elements and controls therefor, the controller may be coupled to various electronic devices associated with the cooking elements and/or controls rather than the cooking elements and/or controls themselves, e.g., igniters, electromechanically-controlled valves, control position sensors, etc.

Controller 42 may also be interfaced with various sensors 58 located to sense environmental conditions inside of and/or external to cooking appliance 40, e.g., one or more temperature sensors, humidity sensors, air quality sensors, smoke sensors, flame sensors, carbon monoxide sensors, odor sensors and/or electronic nose sensors, among others. Such sensors may be internal or external to cooking appliance 40, and may be coupled wirelessly to controller 42 in some embodiments.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Figure 3:
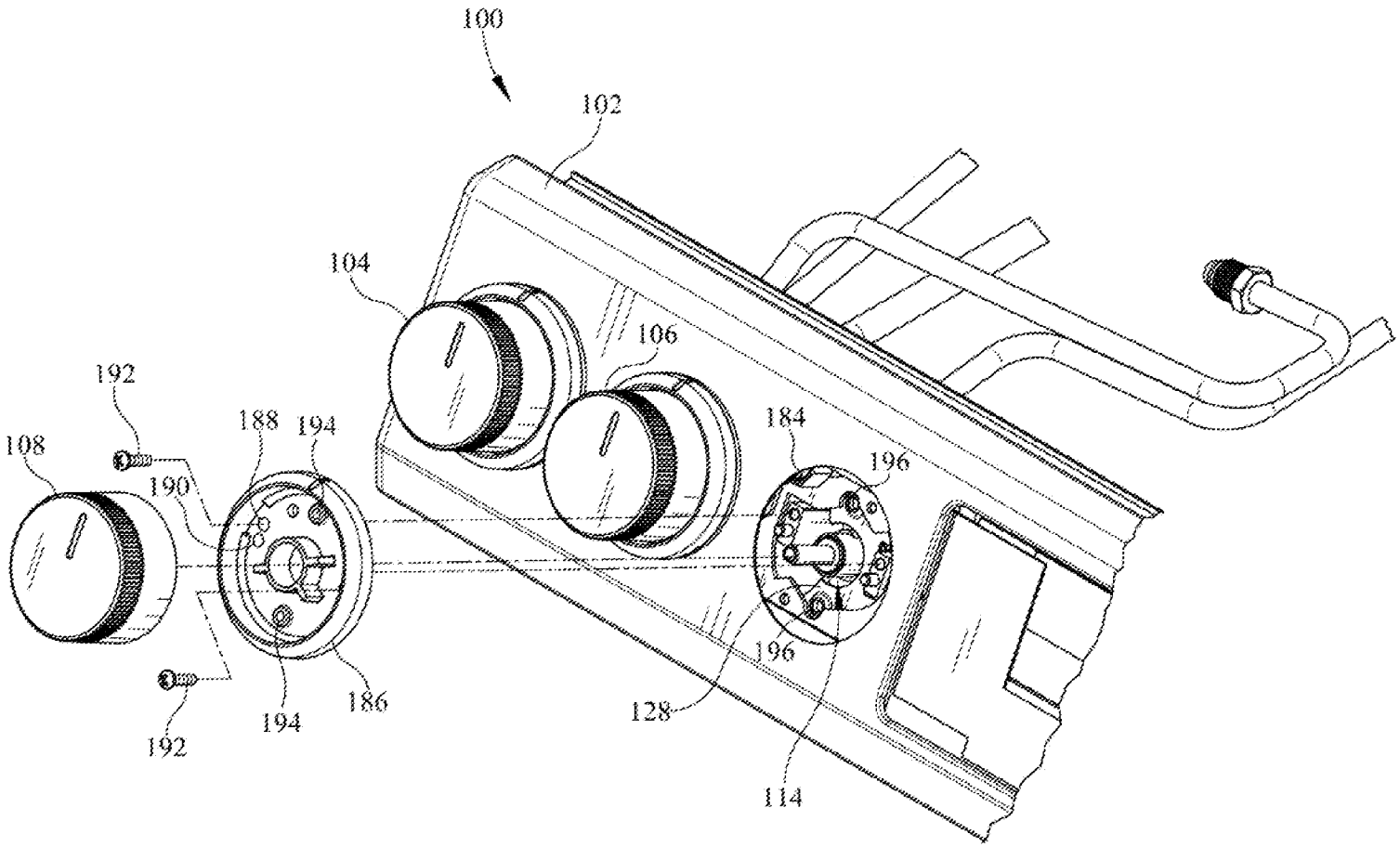
FIG. 3 is a partially-exploded front perspective view of a portion of a cooking appliance consistent with some embodiments of the invention.
Figure 4:
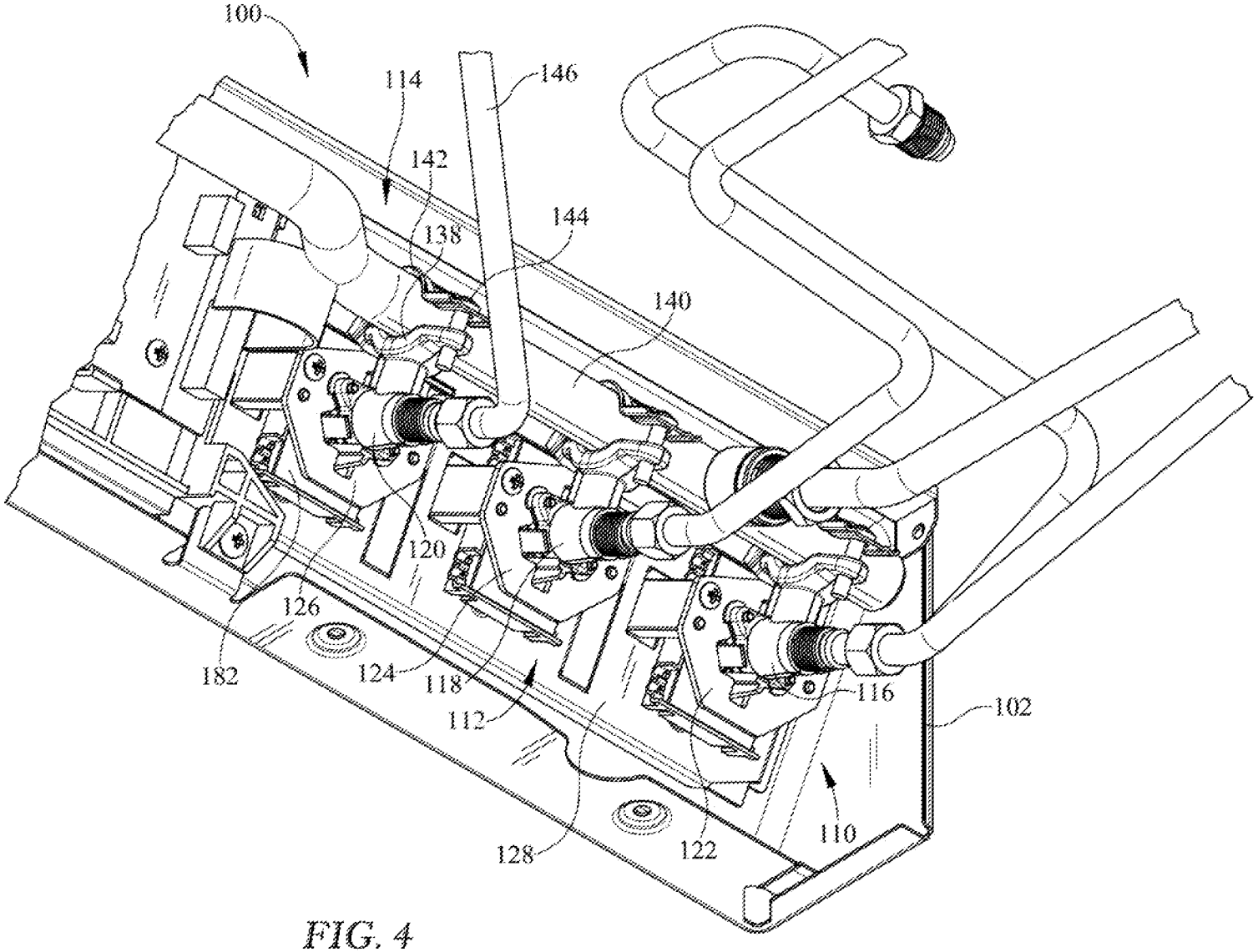
FIG. 4 is a rear perspective view of the portion of the cooking appliance illustrated in FIG. 3.

As noted above, embodiments consistent with the invention may utilize a gas valve mounting assembly to mount a gas valve for a gas cooktop burner to a control panel. FIGS. 3-4, for example, illustrate a portion of an example cooking appliance 100, including a portion of a control panel 102 including three burner controls 104, 106, 108 for controlling three gas burners (e.g., gas cooktop burners, not shown in FIGS. 3-4). Burner controls 104, 106, 108 may be, in some embodiments, rotary knobs, although the invention is not so limited.

Each burner control 104, 106, 108 is used to actuate a respective gas valve assembly 110, 112, 114 to regulate gas flow to a gas burner, and each gas valve assembly includes a respective gas valve 116, 118, 120 and a respective gas valve mounting assembly 122, 124, 126 that mounts the respective gas valve to control panel 102. In addition, in some instances, one or more additional structures may be disposed on the back side of control panel 102, e.g., a backing plate 128 or other supporting structure and/or a circuit board. Backing plate 128 may include openings through which each gas valve 116, 118, 120 may project, as well as one or more mounting apertures 196 (see FIG. 3) suitable for receiving fasteners for securing a control bezel 186 to the rest of control panel 102, as will be discussed in greater detail below.

Figure 5:
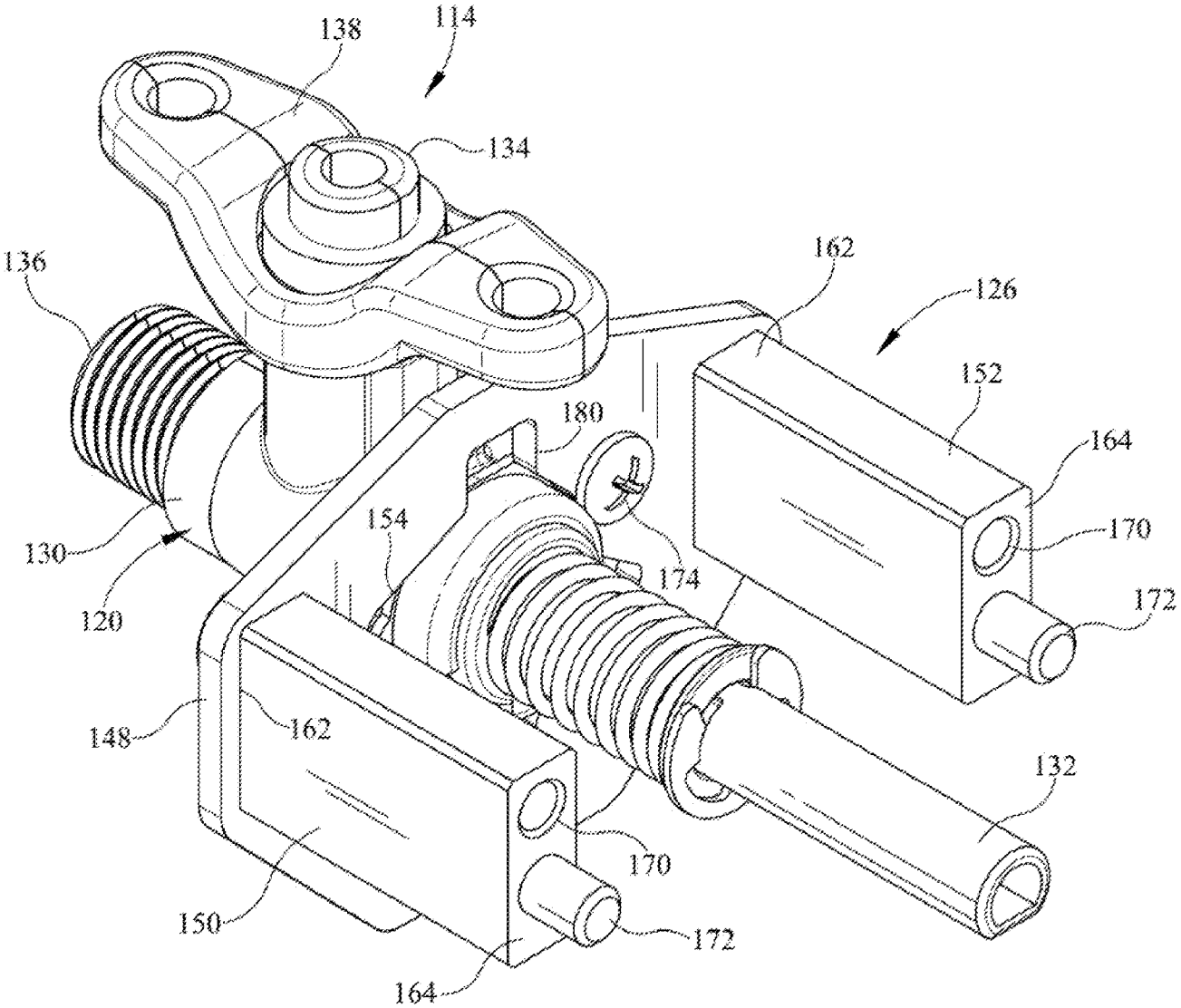
FIG. 5 is a perspective view of one of the gas valve assemblies illustrated in FIGS. 3-4.
Figure 6:
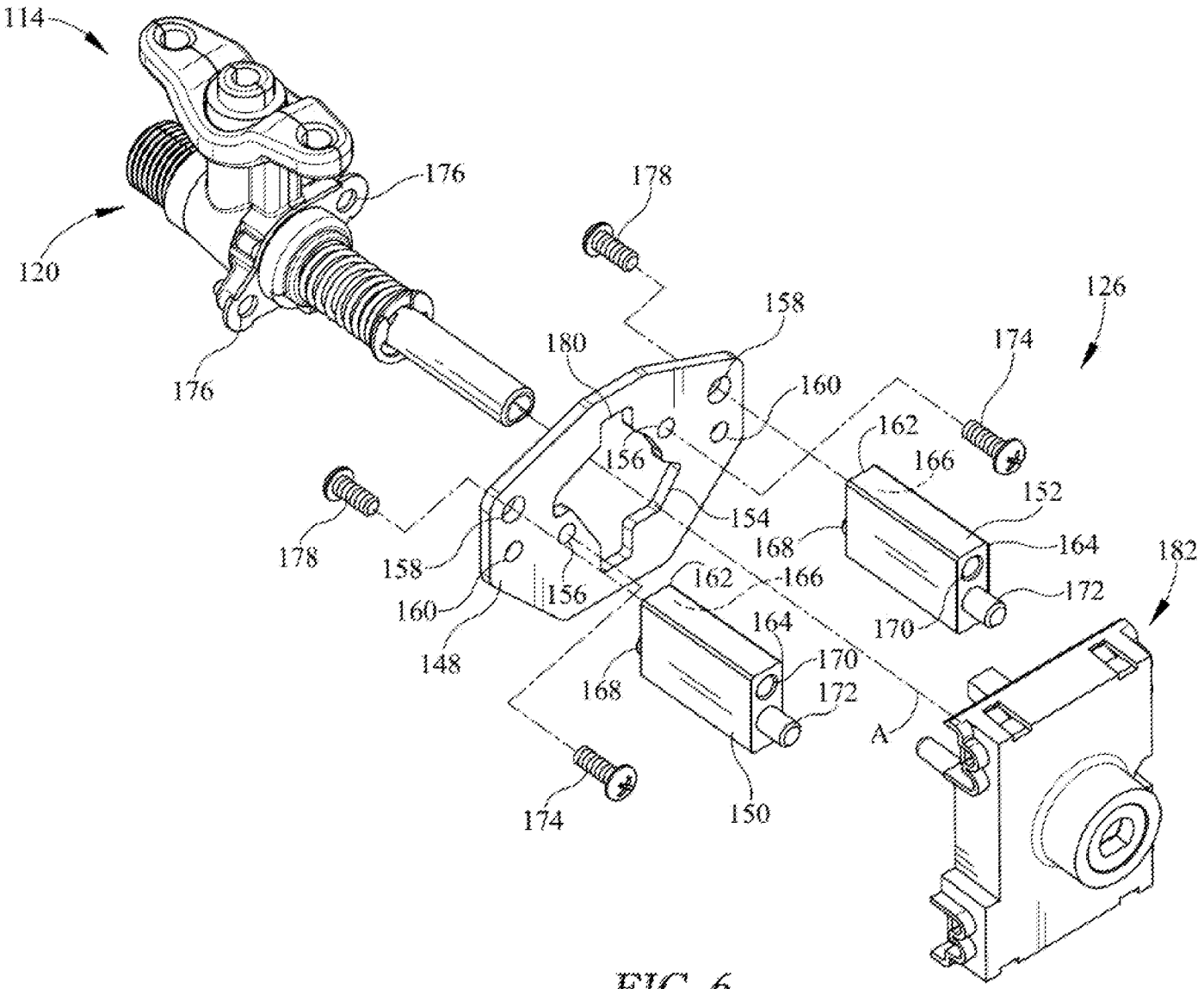
FIG. 6 is an exploded perspective view of the gas valve assembly of FIG. 5.

FIGS. 5-6 illustrate gas valve assembly 114 in greater detail, and it will be appreciated that gas valve assemblies 110 and 112 may be similarly configured. Gas valve 120 of gas valve assembly 114, in particular, includes a valve body 130 and a rotatable shaft 132 that is configured rotate about an actuation axis A (see FIG. 6) to both open and close the gas valve and regulate a flow rate of gas through the gas valve. In some embodiments, rotatable shaft 132 is D-shaped in cross-section, or has another suitable cross-section to restrict relative rotation between rotatable shaft 132 and burner control 108 when burner control 108 is pressed onto rotatable shaft 132 (and in some instances, further secured by a set screw). The gas valve includes an inlet port 134 and an outlet port 136, with a saddle coupling 138 used to couple the inlet port 134 to a manifold 140 using a bracket 142 and one or more threaded fasteners 144, and with outlet port 136 being configured to threadably couple to a gas tube 146 that supplies gas to a gas burner (see FIG. 4). It will be appreciated, however, that the design of gas valve 120 is but one type of gas valve that may be used in the illustrated embodiments, so the invention is not limited to the specific design of gas valve 120.

Gas valve mounting assembly 126 in the illustrated embodiment includes a valve attachment plate 148 and a plurality of standoffs, e.g., standoffs 150, 152. Valve attachment plate 148 secures to and generally circumscribes gas valve 120 and extends generally transversely to actuation axis A, while standoffs 150, 152 extend generally parallel to actuation axis A.

As noted above, valve attachment plate 148 may generally circumscribe gas valve 120, and thus may include a valve aperture 154 through which gas valve 120 may project. In some instances valve attachment plate 148 may only partially circumscribe gas valve 120, e.g., having a C or U shape; however, in the illustrated embodiment, valve attachment plate 148 has a generally O shape and fully circumscribes the gas valve. It is believed that fully circumscribing the gas valve as illustrated herein may be beneficial in some applications as doing so may provide a sturdier assembly that is better able to accommodate bumps or impacts against the associated burner control during use.

Valve attachment plate 148 also includes a pair of valve mounting apertures 156, a pair of standoff mounting apertures 158 and a pair of alignment apertures 160, while each standoff 150, 152 includes respective first and second ends 162, 164, with first end 162 including a fastener recess 166 and alignment pin 168 and second end 164 including a fastener recess 170 and alignment pin 172.

Valve mounting apertures 156 of valve attachment plate 148 are used to mount valve attachment plate 148 to gas valve 120 using a pair of fasteners 174 that engage corresponding fastener recesses 176 in valve body 130 of gas valve 120, while standoff mounting apertures 158 are used to mount valve attachment plate 148 to each standoff 150, 152 using a pair of fasteners 178 that engage fastener recesses 166 in the first ends 162 of standoffs 150, 152. Alignment apertures 160 moreover receive alignment pins 168 to maintain alignment between valve attachment plate 148 and each standoff 150, 152, additionally facilitating assembly prior to securing fasteners 178 to fastener recesses 166.

In some embodiments, gas valve mounting assembly 126 may also be used to mount additional structures to or proximate gas valve 120. For example, as illustrated in FIG. 6, an electrical switch 182 that is actuated by rotation of rotatable shaft 132 (and thus burner control 108) may be supported by gas valve mounting assembly 126, e.g., using one or more recesses or apertures 180 configured to receive one or more tabs on the body of switch 182. Switch 182 in some embodiments may sense a rotational position of rotatable shaft 132, e.g., for the purposes of detecting whether gas valve 120 is open or closed, for activating an ignitor, for activating lights disposed proximate burner control 108 and/or for other suitable purposes. It will be appreciated that various structures may be provided on gas valve mounting assembly 126 to support other types and/or configurations of switches in other embodiments.

Now returning to FIG. 3, gas valve mounting assembly 126 may secure gas valve 120 to control panel 102 with rotatable shaft 132 projecting through a control aperture 184 extending through control panel 102. In the illustrated embodiment, control aperture 184 has an area that is greater than the cross-sectional area of burner control 108, and a control bezel 186 is positioned within control aperture 184. Control bezel 186 includes a pair of mounting apertures 188 and alignment apertures 190 that respectively align with the fastener recesses 170 and alignment pins 172 at the second ends 164 of standoffs 150, 152 such that fasteners 192 extending through mounting apertures 188 and received in fastener recesses 170 will secure gas valve mounting assembly 126 to control bezel 186 of control panel 102. In some instances, fasteners 192 may be sufficient to secure gas valve mounting assembly 126 to control panel 102, while in other instances, it may be desirable to additionally secure control bezel 186 to additional structure on control panel 102, e.g., backing plate 128 (a portion of which is broken away in FIG. 3) using additional fasteners (not shown) extending from the rear of the control panel, through mounting apertures 196 in backing plate 128 and threaded recesses 194 in control bezel 186.

In addition, in some embodiments, control aperture 184 may have a smaller area than the cross-sectional area of burner control 108, such that burner control 108 fully covers the control aperture and such that mounting apertures 188 and alignment apertures 190 may be disposed on the main structure of control panel 102 rather than on control bezel 186. In addition, in some instances, no control bezel may be used.

Moreover, in the illustrated embodiment, each fastener 144, 174, 178, 192 is a threaded fastener such as a screw or bolt, and each fastener recess 166, 170, 176 is a threaded recess, such that each fastener is threadably received in its corresponding fastener recess. It will be appreciated, however, that other types of fasteners, e.g., rivets, may be used in other embodiments.

Valve attachment plate 148 in the illustrated embodiment may be formed from metal sheet stock, e.g., about a 2 mm sheet of steel or aluminum, while standoffs 150, 152 may be cast, molded or machined in different embodiments, e.g., formed of machined aluminum. It will be appreciated, however, that other materials and other manufacturing techniques may be used to form the components of each gas valve mounting assembly. For example, a valve attachment plate may be formed of cut, stamped or formed sheet metal steel or aluminum, or formed as diecast metal parts or machined from a block of metal. Any material having sufficient rigidity to meet appropriate valve standards (e.g., ANSI Z21.15) may also be used. Standoffs 150 and 152 may be cast, molded, or machined from a block of metal, or may be formed from formed or bent sheet metal. Additionally, because standoffs 150 and 152 may not be considered to be part of a valve assembly in some instances (and not subject to ANSI Z21.15 or other international valve standards), they may be considered separate structural pieces, and be made of an even greater variety of materials such as molded plastic. Standoffs may also take different forms in other embodiments, e.g., as simple solid rod shapes that connect on the ends, as hollow tubes that are threaded on the ends, as pieces of threaded rod with shoulders on both ends or simply hollow tubes that act as spacers or washers, e.g., such that one long fastener may extend through each standoff to secure the valve attachment plate to the control panel.

It has found, however, that the use of a flat plate in combination with standoffs that run perpendicular to the plate provides an economical and sturdy configuration that also facilitates assembly of the gas valve assembly and control panel. It will also be appreciated that different numbers of standoffs, different numbers and/or locations of mounting apertures, fastener recesses, alignment apertures and/or alignment pins may be used in other embodiments. Indeed, alignment pins and apertures may not be used in some embodiments, or may be used at one end of each standoff in still other embodiments.

Furthermore, it is believed that the use of a separate plate and standoffs may provide additional design flexibility, thereby enabling, for example, component reuse with different gas valve designs and/or different control panel designs, or to accommodate various types of structures such as switches and the like.

Other modifications may be made to the embodiments discussed herein, and a number of the concepts disclosed herein may be used in combination with one another or may be used separately. Therefore, the invention lies in the claims hereinafter appended.

What is claimed is:

1. A cooking appliance, comprising:

a housing including a cooktop and a control panel;

a gas burner disposed on the cooktop;

a gas valve including a valve body and a rotatable shaft configured to regulate gas flow to the gas burner through rotation of the rotatable shaft about an actuation axis;

a burner control coupled to the rotatable shaft of the gas valve; and a gas valve mounting assembly mounting the gas valve to the control panel of the housing, the gas valve mounting assembly including:

a valve attachment plate that secures to and generally circumscribes the gas valve and extends generally transversely to the actuation axis of the gas valve;

a plurality of standoffs having respective first and second ends and extending generally parallel to the actuation axis of the gas valve, the respective first ends of the plurality of standoffs secured to the valve attachment plate and the respective second ends of the plurality of standoffs secured to the control panel of the housing to thereby mount the gas valve to the control panel of the housing; and a first alignment pin configured to align a first standoff of the plurality of standoffs with the valve attachment plate when the first end of the first standoff is secured to the valve attachment plate.

2. The cooking appliance of claim 1, wherein the control panel includes a control aperture through which the rotatable shaft of the gas valve projects when the gas valve is mounted to the control panel.

3. The cooking appliance of claim 2, wherein the control aperture has an area that is less than a cross-sectional area of the burner control such that the burner control fully covers the control aperture when the burner control is coupled to the rotatable shaft of the gas valve, and wherein the control panel further includes a plurality of mounting apertures through which the plurality of standoffs are secured to the control panel using a plurality of fasteners.

4. The cooking appliance of claim 3, wherein each of the plurality of standoffs includes an alignment pin and a fastener recess disposed at the respective second end thereof, wherein the plurality of fasteners are received in the fastener recesses of the plurality of standoffs, and wherein the control panel further includes a plurality of alignment apertures configured to receive the alignment pins disposed at the respective second ends of the plurality of standoffs to align the plurality of mounting apertures with the fastener recesses of the plurality of standoffs.

5. The cooking appliance of claim 2, wherein the control aperture has an area that is greater than a cross-sectional area of the burner control and the control panel includes a control bezel that is received in the control aperture on an opposite side of the control panel from the gas valve, and wherein the control bezel further includes a plurality of mounting apertures through which the plurality of standoffs are secured to the control panel using a plurality of fasteners.

6. The cooking appliance of claim 5, wherein each of the plurality of standoffs includes an alignment pin and a fastener recess disposed at the respective second end thereof, wherein the plurality of fasteners are received in the fastener recesses of the plurality of standoffs, and wherein the control bezel further includes a plurality of alignment apertures configured to receive the alignment pins disposed at the respective second ends of the plurality of standoffs to align the plurality of mounting apertures with the fastener recesses of the plurality of standoffs.

7. The cooking appliance of claim 1, wherein the valve attachment plate includes a plurality of mounting apertures through which the plurality of standoffs are secured to the valve attachment plate using a plurality of fasteners.

8. The cooking appliance of claim 7, wherein the first alignment pin is formed on the first standoff, wherein each of the plurality of standoffs includes a first alignment pin and a fastener recess disposed at the respective first end thereof, wherein the plurality of fasteners are received in the fastener recesses of the plurality of standoffs, and wherein the valve attachment plate further includes a plurality of alignment apertures configured to receive the first alignment pins of the plurality of standoffs to align the plurality of mounting apertures with the fastener recesses of the plurality of standoffs.

9. The cooking appliance of claim 1, wherein the valve attachment plate fully circumscribes the gas valve and defines a valve aperture through which the gas valve projects.

10. The cooking appliance of claim 9, wherein the gas valve includes a plurality of fastener recesses extending generally parallel to the actuation axis of the gas valve, and wherein the valve attachment plate includes a plurality of mounting apertures through which the valve attachment plate is secured to the gas valve using a plurality of fasteners received in the plurality of fastener recesses.

11. The cooking appliance of claim 9, wherein the valve attachment plate further includes a switch recess configured to receive a portion of an electrical switch that is actuated by rotation of the burner control.

12. A gas valve assembly for a cooking appliance of a type including a control panel and a cooktop having a gas burner, the gas valve assembly including:

a gas valve including a valve body and a rotatable shaft configured to regulate gas flow to the gas burner through rotation of the rotatable shaft about an actuation axis; and a gas valve mounting assembly configured to mount the gas valve to the control panel, the gas valve mounting assembly including:

a valve attachment plate that secures to and generally circumscribes the gas valve and extends generally transversely to the actuation axis of the gas valve;

a plurality of standoffs having respective first and second ends and extending generally parallel to the actuation axis of the gas valve, the respective first ends of the plurality of standoffs secured to the valve attachment plate and the respective second ends of the plurality of standoffs configured to be secured to the control panel to thereby mount the gas valve to the control panel; and a first alignment pin configured to align a first standoff of the plurality of standoffs with the valve attachment plate when the first end of the first standoff is secured to the valve attachment plate.

13. The gas valve assembly of claim 12, wherein each of the plurality of standoffs includes an alignment pin and a fastener recess disposed at the respective second end thereof, wherein the fastener recess disposed at the respective second end of each of the plurality of standoffs is configured to receive a respective fastener that secures the gas valve mounting assembly to the control panel through a respective mounting aperture in the control panel, and wherein the alignment pin disposed at the respective second end of each of the plurality of standoffs is configured to be received in a respective alignment aperture disposed in the control panel.

14. The gas valve assembly of claim 12, wherein the valve attachment plate includes a plurality of mounting apertures through which the plurality of standoffs are secured to the valve attachment plate using a plurality of fasteners.

15. The gas valve assembly of claim 14, wherein the first alignment pin is formed on the first standoff, wherein each of the plurality of standoffs includes a first alignment pin and a fastener recess disposed at the respective first end thereof, wherein the plurality of fasteners are received in the fastener recesses of the plurality of standoffs, and wherein the valve attachment plate further includes a plurality of alignment apertures configured to receive the first alignment pins of the plurality of standoffs to align the plurality of mounting apertures with the fastener recesses of the plurality of standoffs.

16. The gas valve assembly of claim 12, wherein the valve attachment plate fully circumscribes the gas valve and defines a valve aperture through which the gas valve projects.

17. The gas valve assembly of claim 16, wherein the gas valve includes a plurality of fastener recesses extending generally parallel to the actuation axis of the gas valve, and wherein the valve attachment plate includes a plurality of mounting apertures through which the valve attachment plate is secured to the gas valve using a plurality of fasteners received in the plurality of fastener recesses.

18. The gas valve assembly of claim 16, wherein the valve attachment plate further includes a switch recess configured to receive a portion of an electrical switch that is actuated by rotation of the rotatable shaft of the gas valve.

19. A gas valve mounting assembly for mounting a gas valve to a control panel of a cooking appliance of a type including a cooktop having a gas burner, the gas valve including a valve body and a rotatable shaft configured to regulate gas flow to the gas burner through rotation of the rotatable shaft about an actuation axis, the gas valve mounting assembly including:

a valve attachment plate configured to be secured to and generally circumscribe the gas valve and extend generally transversely to the actuation axis of the gas valve;

a plurality of standoffs having respective first and second ends and extending generally parallel to the actuation axis of the gas valve, the respective first ends of the plurality of standoffs secured to the valve attachment plate and the respective second ends of the plurality of standoffs configured to be secured to the control panel to thereby mount the gas valve to the control panel; and a plurality of fasteners securing the plurality of standoffs to the valve attachment plate through a plurality of mounting apertures in the valve attachment plate;

wherein each of the plurality of standoffs includes an alignment pin and a fastener recess disposed at the respective first end thereof;

wherein the plurality of fasteners are received in the fastener recesses of the plurality of standoffs; and wherein the valve attachment plate further includes a plurality of alignment apertures configured to receive the alignment pins of the plurality of standoffs to align the plurality of mounting apertures with the fastener recesses of the plurality of standoffs.

20. The gas valve mounting assembly of claim 19, wherein:

each of the plurality of fasteners is a first fastener;

the alignment pin of each of the plurality of standoffs is a first alignment pin and the fastener recess of each of the plurality of standoffs is a first fastener recess;

each of the plurality of standoffs further includes a second alignment pin and a second fastener recess disposed at the respective second end thereof; and the plurality of second fastener recesses are configured to receive a plurality of second fasteners that secure the gas valve mounting assembly to the control panel through a plurality of second mounting apertures in the control panel, and the plurality of second alignment pins are configured to be received in a plurality of second alignment apertures disposed in the control panel.

* * * * *